United States Patent [19]

Hanna

[11] 4,285,101

[45] Aug. 25, 1981

[54] ELONGATED IMPLEMENT CLIP

[76] Inventor: Arthur W. Hanna, 9706 Wheatland Ave., Sunland, Calif. 91040

[21] Appl. No.: 132,676

[22] Filed: Mar. 21, 1980

[51] Int. Cl.[3] ..... A44B 21/00; A45F 5/02; B43K 25/00

[52] U.S. Cl. ..... 24/3 L; 24/3 H; 24/11 R; 24/11 C; 401 131/; 401/195

[58] Field of Search ..... 24/3 L, 3 H, 3 K, 10 R, 24/11 R, 11 HC, 11 CT, 12; 401/131

[56] References Cited

U.S. PATENT DOCUMENTS

| | | | |
|---|---|---|---|
| 942,366 | 12/1909 | Deeter | 24/3 J |
| 1,068,209 | 7/1913 | Bird | 24/3 H |
| 1,073,053 | 9/1913 | Lawson et al. | 24/3 L |
| 2,272,674 | 2/1942 | Kehr | 24/3 J |
| 2,453,034 | 11/1948 | Pizzarelli | 24/12 |
| 2,541,669 | 2/1951 | Rosa | 24/12 |
| 2,612,669 | 10/1952 | Brueckner | 24/12 |
| 2,613,413 | 10/1952 | Budny | 24/10 R |
| 2,964,812 | 12/1960 | Cook | 401/131 |

*Primary Examiner*—Victor N. Sakran
*Attorney, Agent, or Firm*—Jack C. Munro

[57] ABSTRACT

The forming of an enlarged section on the clip of an elongated implement, such as a pen or pencil, which is to facilitate one handed movement of the clip so as to readily connect the implement to a shirt or other sheet material structure.

2 Claims, 6 Drawing Figures

Fig. 1
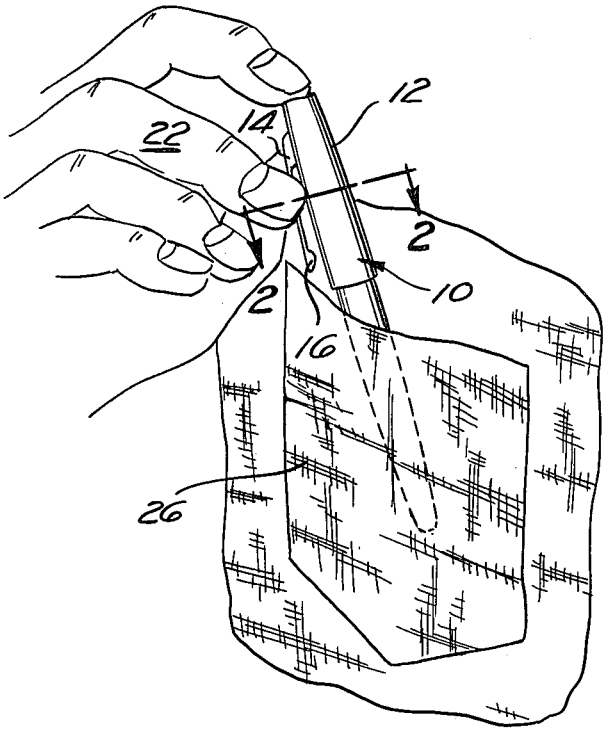
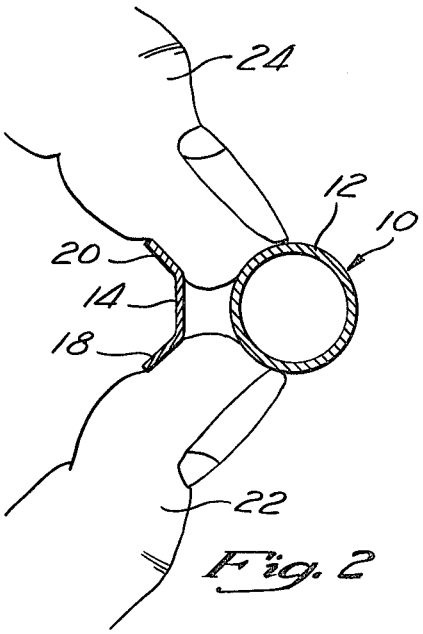
Fig. 2
Fig. 3
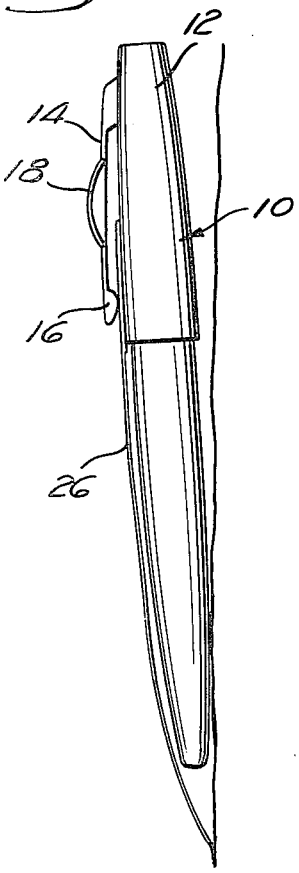
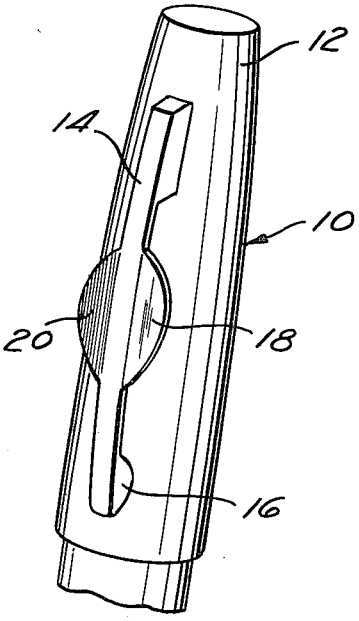
Fig. 4
Fig. 5
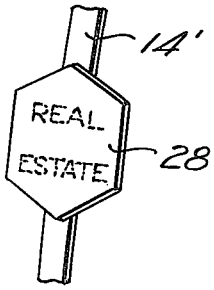
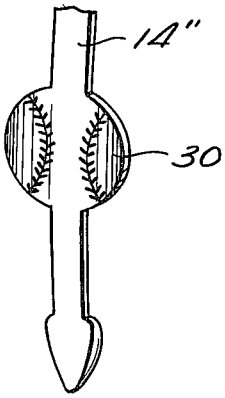
Fig. 6

ELONGATED IMPLEMENT CLIP

BACKGROUND OF THE INVENTION

The field of this invention relates to a retaining clip which is frequently employed in conjunction with writing instruments and other elongated implements.

Retaining clips in conjunction with writing instruments, tire pressure gauges and other types of elongated implements have been known for some time. The retaining clip normally comprises a thin elongated member one end of which is secured to the body of the implement while the other end of the member is movable. This other end is continuously biased toward contact with the implement. Upon movement of the other end away from the implement, a sheet material article, such as a section of fabric, a piece of paper, cover of a book, or the like, is to be inserted between the retaining clip and the implement thereby securing the implement to the article. The purpose of the clip is to prevent accidental dislodgement of the implement from the article to which it is connected but yet also readily permits detachment of the implement from the article.

All known clips of the prior art require to be installed with two hands. The normal procedure is for an operator to grasp the elongated implement with one hand and the clip with the other hand and then to deflect the clip away from the implement while inserting of the implement into its desired location. After the shirt pocket or other sheet material has been located between the clip and the implement, the operator then releases the clip and removes his hands from the implement leaving the implement connected in the desired manner. This procedure is undesirable since it requires the use of two hands. Frequently, a person does not have both hands available and it would be desirable to connect the implement with the use of only a single hand.

SUMMARY OF THE INVENTION

The structure of this invention is summarily described in the Abstract of the Disclosure and reference is to be had thereto.

The primary object of this invention is to construct a clip for an elongated implement which can be easily and quickly operated with one hand in connecting the implement to a sheet material structure.

BRIEF DESCRIPTION OF THE DRAWING

FIG. 1 is a cross-sectional view showing the installation procedure for the clip of this invention in attaching of a writing implement to a shirt pocket;

FIG. 2 is a cross-sectional view taken along line 2—2 of FIG. 1;

FIG. 3 is a side view of the writing implement of FIG. 1 showing the implement as connected to the shirt pocket;

FIG. 4 is an enlarged isometric view of the clip of this invention;

FIG. 5 is an isometric view of a first modified form of design of the clip of this invention; and FIG. 6 is an isometric view of a second modified form of design of the clip of this invention.

DETAILED DESCRIPTION OF THE SHOWN EMBODIMENT

Referring particularly to the drawing, there is shown in FIG. 1 the writing implement 10 which has a cap 12 which is used to cover the tip of the writing instrument (not shown). Fixedly secured at one end thereof to the exterior surface of the cap 12 is a clip 14. The outer end 16 of the clip 14 is not attached to the cap 12 but is merely adapted to normally rest thereagainst. The clip 14 is constructed to have a natural bias positioning the end 16 against the end 12.

At approximately the longitudinal center of the clip 14 there is located an enlarged section which takes the form of a first flange 18 and a second flange 20. The flanges 18 and 20 are mirror images of each other. The size of the flanges 18 and 20 are deemed to be optional. It is understood that the flanges 18 and 20 are substantially enlarged from the width of the clip 14.

Noting particularly FIG. 2 of the drawing, it can be seen that the flanges 18 and 20 are flared outwardly with respect to the writing implement 10. This is so that the operator can place a finger 22 so as to wedge between the flange 18 and the cap 12. The operator also simultaneously wedges his thumb 24 between the flange 20 and the cap 12. The result is that the end 16 becomes spaced from the cap 12 permitting entry therebetween of a sheet material article such as a shirt pocket 26. The flaring outwardly of the flanges 18 and 20 is so as to easily accommodate the wedging action of the finger 22 and the thumb 24.

After the sheet material article 26 is located as is shown within FIG. 3 of the drawing, the operator then releases the clip 14 which permits the end 16 to move toward the cap 12 thereby wedging the shirt pocket 26 between the end 16 and the cap 12. The writing implement 10 is then securely held to the shirt pocket 26.

It is to be understood that when it is desired to remove the writing implement 10 from the shirt pocket 26, the operator can also again wedge his finger 22 and the thumb 24 so as to facilitate removal of the writing implement 10. However, this is not particularly necessary and merely an outward movement of the writing implement 10 will cause removal of such from the shirt pocket 26.

Noting particularly FIGS. 5 and 6 of the drawing, there are shown modified forms 28 and 30 of the enlarged section of the clip 14' and 14'', respectively. The modified forms which are shown in FIGS. 5 and 6 are merely examples of different types of designs that can be incorporated in conjunction with the enlarged sections 28 and 30. These designs can take the form of advertising or can be mere ornamentation. It is to be noted that the designs will be readily visible since they will be located exteriorly of the pocket 26.

What is claimed is:

1. In combination with an elongated implement, said implement having a clip one end of which is attached to said implement and an opposite end being detached from said implement, said opposite end being continuously biased into contact with said implement, said clip having a narrow elongated body, said body to be capable of being manually grasped and said opposite end moved out of contact with said implement permitting a section of sheet material to be located between said implement and said body, the improvement comprising:

means connected to said clip facilitating one handed movement of said opposite end, said means comprising an enlarged section attached to said body, said enlarged section substantially increasing the width of said body, said enlarged section being located intermediate said one end and said opposite end of said clip, whereby a person is to locate a thumb on one side of said enlarged section and a finger on the opposite side of said enlarged section and exert a slight wedging action between said implement and said enlarged section which results in movement of said opposite end out of contact with said implement thereby permitting insertion of said sheet material between said clip and said implement.

2. The combination as defined in claim 1 wherein:

said sides of said enlarged section being flared outwardly from said implement.

* * * * *